US008177085B2

(12) United States Patent
Hopps

(10) Patent No.: US 8,177,085 B2
(45) Date of Patent: May 15, 2012

(54) TOOTH PROTECTOR

(76) Inventor: Krag David Hopps, Houston, TX (US)

( * ) Notice: Subject to any disclaimer, the term of this patent is extended or adjusted under 35 U.S.C. 154(b) by 545 days.

(21) Appl. No.: 12/362,487

(22) Filed: Jan. 29, 2009

(65) Prior Publication Data

US 2010/0186755 A1 Jul. 29, 2010

(51) Int. Cl.
*B65D 83/00* (2006.01)
*A47G 19/22* (2006.01)

(52) U.S. Cl. ..... 215/387; 220/703; 220/711; 220/713; 220/716; 220/718

(58) Field of Classification Search ..... 215/387; 220/703, 711, 713, 716, 718; 128/861
See application file for complete search history.

(56) References Cited

U.S. PATENT DOCUMENTS 2,317,046 A * 4/1943 Fleming ..... 220/717
2,678,142 A * 5/1954 Creed ..... 220/717
3,595,421 A * 7/1971 Sanchis ..... 215/309
5,613,616 A * 3/1997 Monus ..... 220/791
5,749,491 A * 5/1998 Wylder et al. ..... 220/719
2008/0149650 A1* 6/2008 Kim ..... 220/716

* cited by examiner

*Primary Examiner* — Anthony Stashick
*Assistant Examiner* — Madison L Wright
(74) *Attorney, Agent, or Firm* — Gordon G. Waggett, P.C.

(57) ABSTRACT

A tooth protector device is disclosed for attachment to the top of a glass bottle to provide protection against injury, including chipping of teeth that can occur during drinking from a glass bottle. One embodiment comprises a monolithic structure for insertion into the mouth of a glass bottle and comprises inner, outer and top portions. The inner portion and the outer portion are substantially concentric structures defining an annulus for engaging the mouth of the bottle, and the top portion joins the inner and outer portions and protects the consumer from the top edge of the bottle. The length of the outer portion is selected such that the bottom part of the consumer's mouth is protected from the bottle. When installed, a tooth protector according to the present invention cushions the teeth and mouth from any blunt force or impulse that can occur when a bottle is hit or blocked.

6 Claims, 1 Drawing Sheet

TOOTH PROTECTOR

BACKGROUND OF THE INVENTION

1. Field of the Invention

The present invention relates to a device for attachment to the top of the bottle to provide protection against injury to teeth when drinking from the bottle.

2. Description of the Prior Art

It is a well-known fact that drinking a beverage from a glass bottle implicates the risk of damage to the teeth of the person consuming the beverage. Such damage may, for example, range from relatively minor chipping of the tooth which requires restoration to more pronounced damage which requires tooth replacement. The risk of tooth damage from drinking from a glass bottle is heightened when it is done in a public location such as a bar or sporting event and particularly when the beverage being consumed is an alcoholic beverage.

No device has heretofore been available to protect a person's teeth when he/she is drinking from a glass bottle. This new and useful result has been obtained by the tooth protector of the present invention.

SUMMARY OF THE INVENTION

A tooth protector for a glass bottle is provided to aid in the prevention of teeth being broken or chipped when a person is consuming liquid from the bottle. A tooth protector in accordance with the present invention comprises a monolithic structure for insertion into the mouth of the bottle, and the monolithic structure comprises inner, outer and top portions. The inner and outer portions comprise substantially concentric structures which define an annulus between them for engaging the mouth of the bottle. The top portion of the tooth protector joins the inner and outer portions, and the outer portion and the top portion respectively provide protection to the consumer's teeth from the top part of the neck and the top edge of the bottle when the tooth protector is inserted into the mouth of the bottle. In one embodiment, the inner portion of the tooth protector comprises an inner face having a bulge to prevent the tooth protector from leaking while the liquid contents of the bottle are being consumed. In this embodiment, the inner portion of the tooth protector also comprises an outer face which is tapered to squeeze the inner portion of the tooth protector tightly against the bottle. A tooth protector in accordance with the present invention may be fabricated from rubber or soft plastic and it may further comprise a clip for attachment of the tooth protector to a keychain or similar structure.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 2:
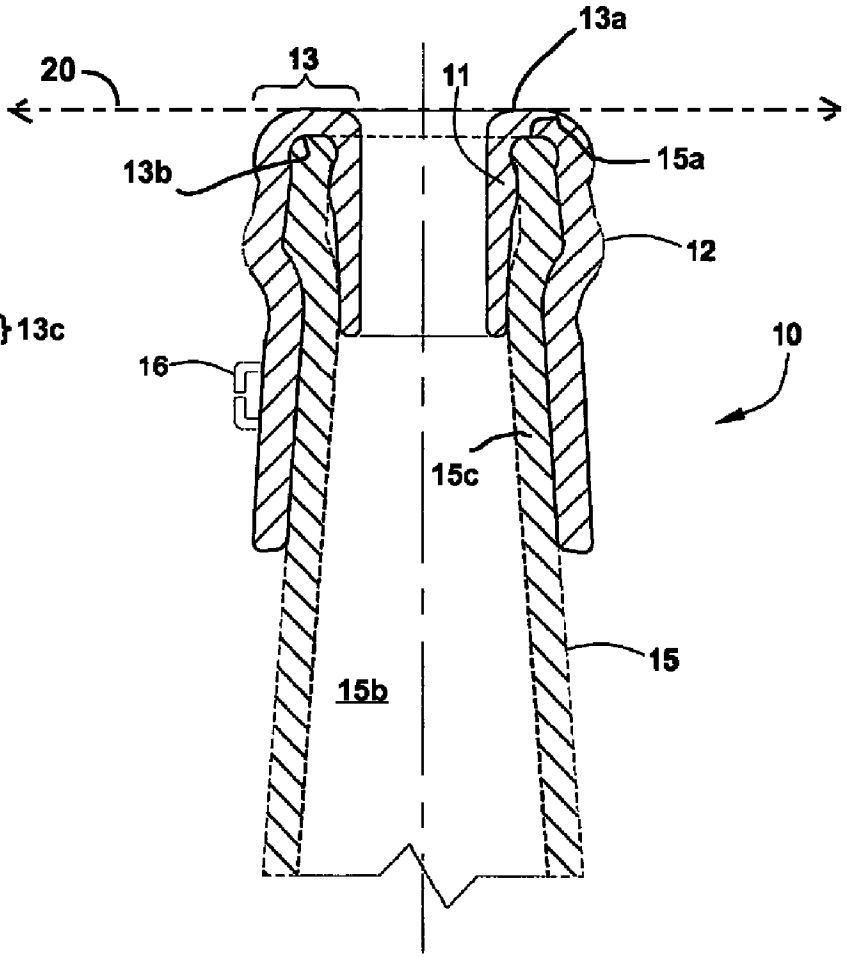
FIG. 2 is an elevation view in cross-section which illustrates the tooth protector of FIG. 1 installed in the mouth of a glass bottle.
Figure 1:
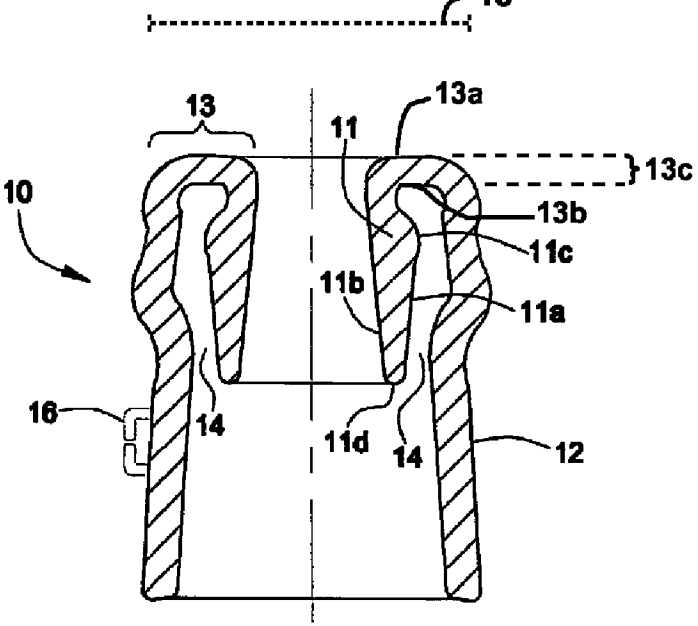
FIG. 1 is an elevation view in cross-section of one embodiment of a tooth protector in accordance with the present invention.

Referring to FIGS. 1 and 2, tooth protector 10 in accordance with the present invention is a monolithic structure for insertion into the mouth of a glass bottle and comprises an inner portion 11, an outer portion 12 and a top portion 13. Inner portion 11 and the outer portion 12 are substantially concentric structures and define an annulus 14.

Tooth protector 10 may be attached to the glass bottle 15 by inserting the inner portion 11 into the mouth of the glass bottle 15. The annulus 14 receives the neck of the bottle 15. The bottle 15 has a top edge 15*a* defining a mouth opening into the interior space 15*b* of bottle 15 and a top section 15*c* extending downwardly from the top edge 15*a*. The top portion 13 of tooth protector 10 has an outer surface 13*a* and an inner surface 13*b* and a height 13*c* defined as the distance between the outer surface 13*a* and the inner surface 13*b*. The height 13*c* is substantially uniform along the top portion 13. The top portion 13 of tooth protector 10 joins the inner portion 11 and the outer portion 12, and the outer portion 12 and top portion 13 respectively protect the consumer's teeth from the top part of the neck and top edge of glass bottle 15 when the tooth protector is inserted in the mouth of the bottle. The concentric outer portion 12 defines an overall width or outer annular diameter 18 across the top portion 13 of the protector 10. The outer surface 13*a* forms a horizontal plane 20 across the width 18 of the protector. The concentric inner portion 11 and outer portion 12 extend downwardly below the horizontal plane 20. The protector 10 does not comprise structure extending above the horizontal plane 20. The length of outer portion 12 is selected such that the bottom part of the consumer's mouth is protected from the bottle.

Inner portion 11 of tooth protector 10 comprises an inner face 11*a* and an outer face 11*b*. The inner face 11*a* comprises a bulge 11*c* which functions as a seal to prevent the tooth protector 10 from leaking when the liquid contents of bottle 15 are being consumed. The outer face 11*b* is tapered outwardly as shown to squeeze the inner portion 11 tightly against bottle 15 to prevent leaking. The ends 11*d* of inner portion 11 of tooth protector 10 may be rounded for smooth and easy insertion of the tooth protector 10 into bottle 15.

A tooth protector in accordance with the present invention may be fabricated from a rubber material or a soft plastic material. In one embodiment, a tooth protector in accordance with the present invention may also comprise a clip 16 for attachment of the tooth protector to a keychain or similar structure.

What is claimed is:

1. A tooth protector comprising a monolithic structure for attachment to a top of a bottle, the bottle having a neck section comprising a top edge defining a mouth opening into the bottle and a top section extending downwardly from the top edge, the tooth protector comprising:

an inner portion, an outer portion, and a top portion, said inner and outer portions comprising substantially concentric structures which define an annulus between them for engaging the mouth of the bottle and the top portion joining said inner and outer portions, said outer portion defining an overall protector width, the outer and top portions respectively providing protection from the top section of the neck and the top edge of the bottle when the tooth protector is inserted into the mouth of the bottle, said top portion having an inner surface and an outer surface and a height defined as a distance between the inner surface and the outer surface, the top portion defining a horizontal plane across said width of the protector, said height being substantially uniform along the top portion, the protector not comprising structure that extends above said horizontal plane.

2. The tooth protector of claim 1, wherein the inner portion comprises an inner face having a bulge to prevent the tooth protector from leaking when liquid contents contained within the bottle are being consumed.

3. The tooth protector of claim 2, wherein the inner portion thereof comprises an outer face which is tapered to squeeze the inner portion of the tooth protector tightly against the bottle.

4. The tooth protector of claim 1, wherein it is fabricated from rubber.

5. The tooth protector of claim 1, wherein it is fabricated from soft plastic.

6. The tooth protector of claim 1, further comprising a clip on the outer portion.

* * * * *